US006558864B2

(12) United States Patent
Ishiyama et al.

(10) Patent No.: US 6,558,864 B2
(45) Date of Patent: May 6, 2003

(54) TONER FOR DEVELOPING ELECTROSTATIC IMAGE, METHOD FOR PRODUCING THE SAME, ELECTROSTATIC IMAGE DEVELOPER, METHOD FOR FORMING IMAGE AND IMAGE FORMING APPARATUS

(75) Inventors: Takao Ishiyama, Minamiashigara (JP); Hiroshi Takano, Minamiashigara (JP); Yasuo Kadokura, Minamiashigara (JP); Yasuo Matsumura, Minamiashigara (JP); Hideo Maehata, Minamiashigara (JP); Masaaki Suwabe, Minamiashigara (JP); Shuji Sato, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/946,523

(22) Filed: Sep. 6, 2001

(65) Prior Publication Data

US 2002/0058190 A1 May 16, 2002

(30) Foreign Application Priority Data

Sep. 8, 2000 (JP) ..... 2000-272861

(51) Int. Cl.[7] ..... G03G 9/113

(52) U.S. Cl. ..... 430/108.6; 430/108.7; 430/137.14

(58) Field of Search ..... 430/108.7, 108.6, 430/137.14

(56) References Cited

U.S. PATENT DOCUMENTS 5,660,959 A 8/1997 Moriyama et al.
5,804,351 A * 9/1998 Takano et al. ..... 430/108.1
6,025,106 A * 2/2000 Azuma et al. ..... 430/108.7
6,117,607 A * 9/2000 Shimizu et al. ..... 430/108.7
6,287,739 B1 * 9/2001 Kawakami et al. ..... 399/222

FOREIGN PATENT DOCUMENTS

| | | |
|---|---|---|
| JP | A 59-218459 | 12/1984 |
| JP | A 59-218460 | 12/1984 |
| JP | A 63-282752 | 11/1988 |
| JP | A 4-69664 | 3/1992 |
| JP | A 4-69666 | 3/1992 |
| JP | A 5-61239 | 3/1993 |
| JP | A 6-250439 | 9/1994 |
| JP | A 9-258481 | 10/1997 |
| JP | B2 3028185 | 2/2000 |

* cited by examiner

*Primary Examiner*—Mark A. Chapman
(74) *Attorney, Agent, or Firm*—Oliff & Berridge, PLC

(57) ABSTRACT

Provided are a toner and its production, a developer, an image forming method and an image forming apparatus. The toner has excellent fixation characteristics of good releasability, hot offset resistance, folding resistance, surface glossiness, and OHP transparency. The toner contains a binder resin, a colorant, a release agent and an inorganic particles. The inorganic particles therein contain inorganic particles (A) having the mean primary particle size not less than approximately 5 nm and less than approximately 30 nm and inorganic particles (B) having the mean primary particle size not less than approximately 30 nm and less than approximately 200 nm.

15 Claims, 2 Drawing Sheets

TONER FOR DEVELOPING ELECTROSTATIC IMAGE, METHOD FOR PRODUCING THE SAME, ELECTROSTATIC IMAGE DEVELOPER, METHOD FOR FORMING IMAGE AND IMAGE FORMING APPARATUS

BACKGROUND OF THE INVENTION

1. Field of the Invention

The present invention relates to a toner for developing an electrostatic image, which is used in developing electrostatic latent images with a developer in electrophotography or in an electrostatic recording process, etc., to a method for producing it, and also to an electrostatic image developer, a method for forming an image and an image forming apparatus.

2. Description of the Related Art

Visualization of image information via electrostatic images in electrophotography or the like is now utilized in various fields. In electrophotography, electrostatic latent images are formed on a photoreceptor through static charging and exposure to light, then they are developed with a toner-containing developer, and the resulting toner images are transferred and fixed on recording media, on which the images are thus visualized.

The developer to be used therein includes a two-component developer that contains a toner and a carrier, and a mono-component developer of a magnetic or non-magnetic toner alone. For producing the toner, generally employed is a kneading and grinding method that includes melting and kneading a thermoplastic resin along with a pigment, a charge control agent and a release agent such as wax, cooling the resulting mixture, then grinding it, and classifying the resulting particles. To the toner, optionally added are inorganic or organic particles, which adhere to the surfaces of the toner particles to thereby improve the flowability and the cleanability of the toner. The method is effective for producing high-quality toners, but involves some problems such as those mentioned below.

In such an ordinary kneading and grinding method, the morphology and the surface structure of the toner particles produced could not be controlled, and they delicately vary depending on the grindability of the starting materials used and on the condition employed in the grinding step. In the method, therefore, it is difficult to obtain toner particles having a specifically defined morphology and a specifically defined surface structure. In addition, in the kneading and grinding method, the starting materials to be used are limited. Concretely, the resin colorant dispersion to form a toner must be brittle so that it can be well ground in an economic device. However, if the resin colorant dispersion is too brittle, the toner containing it will release fine powder in a development unit, when having received mechanical shear force in the unit, and, as the case may be, the toner morphology will be often changed. This will have some negative influences on the function of developers. For example, in a two-component developer, fine powder of the toner will adhere to and solidify on the surfaces of carrier particles to thereby much deteriorate the chargeability of the developer; and in a mono-component developer, the particle size distribution of toner particles will be broadened, and, as a result, the toner will scatter and its morphology will change to worsen its ability to develop images, whereby the quality of the images developed will be lowered. In case where a large quantity of a release agent such as wax is added to prepare a toner, the release agent is often exposed out on the surfaces of the toner particles, depending on the type of the thermoplastic resin combined with it, and this is problematic. In particular, in a combination of a resin which contains an increased amount of a high-molecular component so as to increase its elasticity and which is therefore difficult to grind, and a brittle wax such as polyethylene, polyethylene will be readily exposed out on the surfaces of toner particles. This will be favorable in point of the releasability in toner fixation and of the cleanability of non-transferred toner from photoreceptors, but the polyethylene having been exposed out on the toner surfaces will readily move owing to external force applied thereto, and will soil development rollers and photoreceptors and or will contaminate carrier particles, whereby the reliability in image formation will be lowered.

For amorphous toner, its flowability could not be increased to a satisfactory level even when a flowability improver is added thereto. In that case, fine particles existing on the surfaces of the toner particles will move to the recesses of the surfaces owing to the mechanical shear force that may be applied to the toner particles in a duplicator, whereby the flowability of the toner will be time-dependently lowered; or the flowability promoter will be embedded inside the toner particles whereby the developability, the transferability and the cleanability of the toner will be worsened. In case where the toner recovered in a cleaning zone in a duplicator is returned to the development unit therein, the quality of the images formed will be further worsened. If the amount of the flowability promoter in the toner is increased so as to solve the problems, peppers will appear on photoreceptors, and the promoter particles will much scatter.

Recently, some methods have been proposed for controlling the morphology and the surface structure of toner particles. For example, one method proposed in Japanese Patent Laid-Open Nos. 282752/1988 and 250439/1994 is for producing toner through emulsion polymerization combined with condensation. This includes separately preparing a dispersion of resin particles formed through emulsion polymerization, and a dispersion of a colorant in a solvent, mixing them to form condensed masses of which the size corresponds to the size of the toner particles to be produced, and heating and melting them to form toner particles. According to the method, the toner morphology can be controlled in some degree and the chargeability and the durability of the toner produced can be improved. However, since the inner structure of the toner particles produced therein is nearly uniform, the method is still problematic in that the releasability of the sheet on which toner images are fixed is not good and the transparency in OHP output is not stable.

As so mentioned hereinabove, toner must stably exhibit its capability even under various types of mechanical stress in electrophotography. For this, too much exposure of a release agent out of the surfaces of toner particles must be prevented, the surface hardness of toner particles must be increased not detracting from the fixability of toner, the mechanical strength of toner must be increased, and both the chargeability and the fixability of toner must be ensured.

High-quality images are much desired these days. In particular, high-precision color images are desired, for which the particle size of toner particles is reduced more and more. However, if the size of conventional toner particles having an ordinary particle size distribution is reduced, fine toner powder will increase. Such fine toner powder is problematic in that it contaminates carrier particles and soils photoreceptors, and it scatters. For these reasons, it has heretofore been difficult to realize high image quality and high reliability even though the size of toner particles is reduced. To solve the problem, it is important to realize a sharp particle size distribution of toner particles and to reduce the particle size thereof.

In recent digital full-color duplicators and printers, a color image original is separated into B (blue), R (red) and G (green) through individual color filters, then latent images of dots each having a diameter of from 20 to 70 $\mu$m are formed, corresponding to the original, and they are developed with toners of Y (yellow), M (magenta), C (cyan) and Bk (black) through subtractive color mixture. As compared with conventional monochromatic image-forming machines, a larger quantity of toners must be transferred in such full-color image-forming machines, and in addition, toners corresponding to small-size dots of latent images must be used therein. To that effect, it is more important that the toners for latent images of such small-size dots meet the requirements of uniform chargeability, durability, mechanical strength, and sharp particle size distribution. Considering the recent tendency in the art toward high-speed energy-saving image-forming machines, toners are desired to be fixable at lower temperatures. In view of these, the condensation and melting method is especially favorable for producing small-size toner particles having a sharp particle size distribution.

In full-color image-forming machines, plenty of toners must be well mixed, and it is indispensable to increase the color reproducibility and OHP transparency of the toners.

In general, toners contain a release agent such as polyolefin wax, which is to prevent low-temperature offset in toner fixation. In addition, a small amount of silicone oil is uniformly applied to fuser rollers to thereby improve the high-temperature offset resistance in image formation. As a result, silicone oil often stains the media with images outputted thereon, and the media are sticky and give an unpleasant feel to users. Therefore, applying silicone oil to fuser rollers is undesirable.

To solve the problems, a toner for oilless fixation has been proposed in Japanese Patent Laid-Open No. 61239/1993. This contains a large quantity of a release agent. As containing such a large quantity of a release agent, the releasability of the toner is improved in some degree. However, since the release agent is miscible with the binder resin therein, it could not be uniformly and stably released from the fusing toner, and, as a result, the toner release stability is still unsatisfactory. In addition, since the cohesive force of the binder resin depends on the molecular weight and the glass transition point thereof, it is difficult to directly control the cobwebbing property and the cohesiveness of the fused toner. In addition, some components released from the release agent often interfere with the chargeability of the toner.

To solve the problems, some methods have been proposed. For example, a high-molecular component is added to a binder resin to thereby improve the toughness of the binder resin, as in Japanese Patent Laid-Open Nos. 69666/1992 and 258481/1997; or a binder resin is chemically crosslinked to enhance its toughness, thereby to reduce the cobwebbing property of toner at temperatures at which the toner fuses for fixation and to improve the toner releasability in oilless fixation, as in Japanese Patent Laid-Open Nos. 218460/1984 and 218459/1984.

When a crosslinking agent is added to a binder resin so that the binder resin is thereby crosslinked, as in Japanese Patent Laid-Open Nos. 218460/1984 and 218459/1984, then the stickiness of the toner that contains the crosslinked binder resin, or that is, the cohesiveness thereof in melt will be increased and the toughness of the binder resin itself will be increased, whereby the releasability of the toner in oilless fixation that depends on the processing temperature and on the spreadability of the toner could be improved in some degree. However, even in that method, it is still difficult to improve the surface gloss of the fixed images. In the method, in addition, the folding resistance of the fixed images is poor. When the molecular weight of the crosslinking agent to be added to the binder resin is increased, as in Japanese Patent Laid-Open No. 218460/1984, then the molecular weight of the crosslinked binder resin in the crosslinked region thereof could be increased and therefore the flexibility of fixed images could be improved in some degree. However, it is still difficult to ensure well-balanced elasticity and stickiness of the toner. As a result, it is therefore difficult to satisfy all the requirements of improved toner releasability in oilless fixation, not so much depending on the processing temperature and on the toner spreadability, and improved surface gloss of fixed images and improved OHP transparency. In addition, it is also difficult to control the difference in the surface gloss between different colors of fixed images, while ensuring the expression of the desired surface gloss of fixed images. In particular, when the proposed method is applied to energy-saving fixation units and to high-speed duplicators and printers, satisfactory fixed images could not be obtained.

In Japanese Patent Laid-Open No. 69664/1992, proposed is a method of adding polymer particles or inorganic particles to a toner to thereby improve the high-temperature offset resistance of the toner being fixed. Owing to their filler effect, inorganic particles added to a toner could improve the toughness of the binder resin in the toner while the toner is fused and fixed, whereby the high-temperature offset resistance and the releasability of the toner could be improved. However, the inorganic particles added lower the flowability of the fused toner, and will therefore detract from the low-temperature offset resistance of the toner and the surface gloss of fixed images. In addition, they will often lower the folding resistance of fixed images. Depending on their amount added, the inorganic particles merely increase the stickiness of the fused toner but could not improve the releasability of the fixed toner.

SUMMARY OF THE INVENTION

The present invention has been made in view of the above circumstances, and provides a toner for developing an electrostatic image and a method for producing it, and also an electrostatic image developer, a method for forming an image and an image forming apparatus. Free from the problems noted above, the advantages of the toner are as follows: The releasability of the toner does not fluctuate in oilless fixation at any processing temperatures; the toner enables fixation of images with a good surface gloss, and has good fixation characteristics including adhesiveness of fixed images onto fixation sheets, releasability of image-fixed sheets, hot offset resistance, folding resistance of fixed images, surface glossiness of fixed images and OHP transparency; and the difference in the surface gloss between different colors of the fixed images is reduced.

Having solved the problems noted above, an aspect of the present invention provides a toner for developing an electrostatic image including a binder resin, a colorant, a release agent and an inorganic particles. The inorganic particles contain inorganic particles (A) having the mean primary particle size not less than approximately 5 nm and less than approximately 30 nm and inorganic particles (B) having the mean primary particle size not less than approximately 30 nm and less than approximately 200 nm.

According to another aspect of the invention, a method for producing a toner for developing an electrostatic image includes a step of mixing a dispersion of resin particles not more than 1 $\mu$m in size, a dispersion of a release agent and a dispersion of inorganic particles, a step of preparing a dispersion of aggregated particles, and a step of heating the resulting dispersion to a temperature not lower than the glass transition point or the melting point of the resin particles to form toner particles. The inorganic particles contain inorganic particles (A) having the mean primary particle size not less than approximately 5 nm and less than approximately 30 nm and inorganic particles (B) having the mean primary particle size not less than approximately 30 nm and less than approximately 200 nm.

According to another aspect of the invention, a method for forming an image includes a step of forming an electrostatic latent image on an electrostatic latent image bearing member, a step of developing the electrostatic latent image with a developer on a developer bearing member to form toner image, a step of transferring the toner image onto a transfer medium, and a step of fixing the toner image on the transfer medium. In this method, the developer contains the above-described toner.

According to another aspect of the invention, an image forming apparatus includes an electrostatic latent image bearing member on which an electrostatic latent image is formed, a developer bearing member for bearing a developer, a development unit in which the electrostatic latent image is developed with the developer on the developer bearing member to form a toner image, a transfer unit in which the developed toner image is transferred onto a transfer medium, and a fuser unit in which the toner image on the transfer medium is fixed.

BRIEF DESCRIPTION OF THE DRAWINGS

Preferred embodiments of the invention will be described in detail based on the following figures, wherein.

DESCRIPTION OF THE PREFERRED EMBODIMENTS

Figure 1:
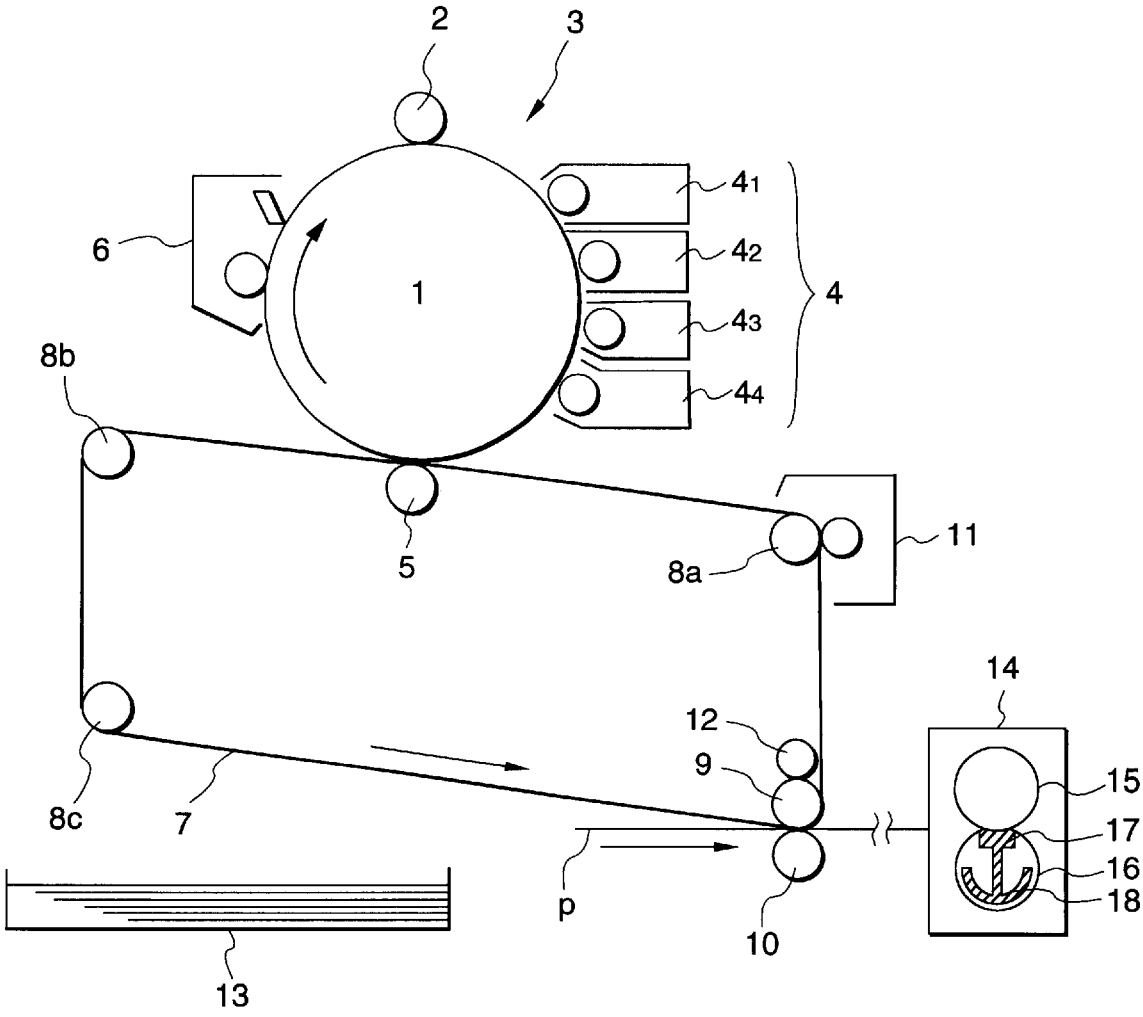
FIG. 1 is a schematic view showing one example of the apparatus for carrying out the image forming method of the invention, which is equipped with a belt fuser.

To overcome the problems noted above, we, the present inventors have assiduously studied, and, as a result, have found that, when an inorganic particles that contain an inorganic particles (A) having the mean primary particle size not less than approximately 5 nm and less than approximately 30 nm and an inorganic particles (B) having the mean primary particle size not less than approximately 30 nm and less than approximately 200 nm are added to a toner for developing an electrostatic image that contains a binder resin, a colorant and a release agent, then the releasability of the toner does not fluctuate even in fixation in a high-speed low-pressure oilless fuser and the fixed toner images are well released. In addition, we have further found that the toner has good offset resistance and enables good image fixation to give toner images having a good surface gloss; that the fixed toner images are well flexible, or that is, they have good folding resistance; that the toner enables good transparency of OHP sheets; and that the difference in the surface gloss between different colors of the fixed toner images is reduced. Concretely, the difference in the surface gloss between different colors of the fixed toner images is as follows: The primary color gloss is at least 30%, the difference between the primary color gloss and the secondary color gloss is at most 15%, and the difference between the primary color gloss and the tertiary color gloss is at most 25%. Preferably, the blend ratio of the inorganic particles A to the inorganic particles B, A/B, is defined to fall between 0.7 and 3.0; and the total of the inorganic particles A and B, A+B, is controlled to fall between 0.5 and 10% by weight of the weight of the toner. Within the preferred ranges, the invention produces better results.

The inorganic particles for use in the invention include silica, hydrophobicated silica, titanium oxide, alumina, calcium carbonate, magnesium carbonate, tricalcium phosphate, colloidal silica, alumina-processed colloidal silica, cation-processed colloidal silica, anion-processed colloidal silica, etc. Prior to being added to the toner, these inorganic particles are ultrasonically dispersed in the presence of an ionic surfactant. Colloidal silica does not always require the treatment for dispersion.

The inorganic particles B for use in the invention, of which the mean primary particle size falls between 30 and 200 nm, are effective for increasing the dynamic viscosity (the viscosity in shaking) of the fused toner in fixation to thereby improve the releasability of the fixed toner images from fixation media. The inorganic particles A of which the mean primary particle size falls between 5 and 30 nm act to lower the static viscosity (the viscosity in stationary condition) of the fixed toner, thereby improving the surface smoothness of the fixed toner images on transfer media such as transfer paper, and improving the surface gloss of the images.

The mean primary particle size of the inorganic particles for use in the invention is measured by observing the inorganic particles in a dispersion containing them, with a scanning electronic microscope.

Preferably, the content ratio of the inorganic particles A to the inorganic particles B (A/B) is controlled to fall between 0.7 and 3.0, based on the amount of the inorganic particles B added to the toner. If the ratio is less than 0.7, the resin viscosity in fixation will increase too much and the flowability of the toner will lower, though the fused toner could be tough. If so, the toner images formed could not be even, and their surface gloss will be low. On the other hand, if the ratio is larger than 3.0, the fixed images could be glossy, but the resin viscosity in fixation will be low and the fused toner could not be tough. If so, the releasability of the toner images will be poor. Anyhow, if the content ratio oversteps the defined range, either one type of the inorganic particles A and B will dominate the other, and two or more types of inorganic particles could not exhibit their effects simultaneously. If so, any one or both of the releasability in fixation and the image surface gloss could not be ensured. More preferably, the content ratio of the inorganic particles A to the inorganic particles B (A/B) falls between 1.0 and 2.0.

Also preferably, the total content of the inorganic particles (A) and the inorganic particles (B) is controlled to fall between 0.5 and 10% by weight of the toner. If it is lower than 0.5% by weight, the inorganic particles added could not ensure their effects. Concretely, the fused toner could not be tough, and its releasability in oilless fixation could not be improved. In addition, the inorganic particles could not be uniformly dispersed in the fused toner, and therefore, the fused toner could not be tough. As a result, the fused toner will be cobwebby and will lose the releasability in oilless fixation. If, on the other hand, the inorganic particle content is larger than 10% by weight, the flowability of the fused toner will greatly lower to worsen the surface glossiness of the toner images, and the fixability of the toner images will be worsened. Concretely, the adhesiveness of the toner to transfer paper lowers, and, as a result, the fixed toner images could not be flexible and could not be resistant to folding stress. More preferably, the total content of the inorganic particles falls between 0.8 and 7.0% by weight.

The polymer to be used for the resin particles in the invention is not specifically defined. For example, it includes homopolymers of monomers, e.g., styrenes such as styrene, parachlorostyrene, α-methylstyrene, etc.; vinyl group-having esters such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, etc.; vinylnitriles such as acrylonitrile, methacrylonitrile, etc.; vinyl ethers such as vinyl methyl ether, vinyl isobutyl ether, etc.; vinyl ketones such as vinyl methyl ketone, vinyl ethyl ketone, vinyl isopropenyl ketone, etc.; polyolefins such as ethylene, propylene, butadiene, etc.; copolymers of two or more such monomers combined; their mixtures; as well as epoxy resins, polyester resins, polyurethane resins, polyamide resins, cellulose resins, polyether resins, non-vinylic condensed resins and their mixtures with vinylic resins such as those mentioned above; graft polymers obtained by polymerizing vinylic monomers in the presence of them, etc.

The vinylic monomers, when used herein, may be polymerized in a mode of emulsion polymerization in the presence of an ionic surfactant or the like to give a dispersion of resin particles. The other resins, if soluble in a solvent that is oily and is relatively poorly soluble in water, may be dissolved in such a solvent, and then dispersed fine in water along with an ionic surfactant or a polyelectrolyte by the use of a dispersing machine such as a homogenizer, to thereby give a fine dispersion of the resin particles.

The particle size of the resin particles in their dispersion may be measured with a laser-diffractiometric particle size analyzer (e.g., Horiba Seisakusho's LA-700).

The colorant for use in the invention is not specifically defined, and may be any known one. Specific examples of colorants usable herein are mentioned below.

Black pigments include carbon black, copper oxide, manganese dioxide, aniline black, activated charcoal, non-magnetic ferrite, magnetite, etc.

Yellow pigments include chrome yellow, zinc yellow, yellow iron oxide, cadmium yellow, Hansa Yellow, Hansa Yellow 10G, Benzidine Yellow G, Benzidine Yellow GR, threne yellow, quinoline yellow, Permanent Yellow NCG, etc.

Orange pigments include red chrome yellow, molybdenum orange, Permanent Orange GTR, pyrazolone orange, vulcan orange, Benzidine Orange G, Indathrene Brilliant Orange RK, Indathrene Brilliant Orange GK, etc.

Red pigments include red iron oxide, cadmium red, red lead, mercury sulfide, Watchung Red, Permanent Red 4R, lithol red, Brilliant Carmine 3B, Brilliant Carmine 6B, Du pont oil red, pyrazolone red, Rhodamine B Lake, Lake Red C, rose bengal, eosine red, alizarine lake, etc.

Blue pigments include iron blue, cobalt blue, alkali blue lake, Victoria blue lake, fast sky blue, Indathrene Blue BC, aniline blue, ultramarine blue, chalcone oil blue, methylene blue chloride, phthalocyanine blue, phthalocyanine green, malachite green oxalate, etc.

Violet pigments include manganese violet, Fast Violet B, methyl violet lake, etc.

Green pigments include chromium oxide, chrome green, pigment green, malachite green lake, Final Yellow Green G, etc.

White pigments include zinc flower, titanium oxide, antimony white, zinc sulfide, etc.

Extender pigments include barite powder, barium carbonate, clay, silica, white carbon, talc, alumina white, etc.

Various dyes are also usable, including basic dyes, acid dyes, disperse dyes, direct dyes, etc. For example, they are nigrosine, methylene blue, rose bengal, quinoline yellow, ultramarine blue, etc.

These may be used herein either singly or combined, or in the form of solid solution.

The colorant may be dispersed in any known manner. For example, preferably used are rotary shear homogenizers, media-assisted dispersing machines such as ball mills, sand mills, attritors, as well as high-pressure collision-type dispersing machines.

Using the homogenizer, the colorant may be dispersed in water in the presence of a polar surfactant to give an aqueous system.

The colorant to be used in the invention is selected from the viewpoint of the hue angle, the saturation, the lightness, the weather proofness, the OHP transmittance, and the dispersibility in the toner. The amount of the colorant to be added to the toner may fall between 1 and 20 parts by weight, but preferably between 3 and 15 parts by weight, relative to 100 parts by weight of the binder resin.

However, magnetic black colorants differ from the other colorants. The amount of the magnetic black colorant that may be in the toner shall fall between 30 and 100 parts by weight, preferably between 40 and 90 parts by weight.

In case where the toner of the invention is used in the form of a magnetic toner, it may contain magnetic powder. The magnetic powder may be a substance capable of being magnetized in a magnetic field, including, for example, ferromagnetic powder of iron, cobalt, nickel or the like, as well as magnetic compounds such as ferrite, magnetite, etc.

In the invention, the toner is prepared in an aqueous phase. Therefore, special attention shall be paid to the aqueous phase transferability of the magnetic substance. Preferably, the magnetic substance is surface-modified, for example, it is hydrophobicated.

For the release agent for use in the invention, preferred is a substance of which the essential component gives a maximum peak in the range falling between 50 and 140° C., measured according to ASTM D3418-8. If the maximum peak appears at a temperature lower than 50° C., the toner will cause offset in fixation; but if higher than 140° C., the fixation temperature will be too high and the fixed images could not have a smooth surface and will lose a gloss on their surface. More preferably, the maximum peak appears in the range falling between 80 and 115° C.

To measure the maximum peak, for example, herein used is Parkin Elmer's DSC-7. For temperature correction at the detector of the measuring device, used are the melting point of indium and that of zinc; and for calorie correction, used is the heat of fusion of indium. The sample to be measured is put on an aluminum pan and heated at a heating rate of 10° C./min, with an empty pan for control being heated in the same manner.

Examples of the release agent usable herein include low-molecular polyolefins such as polyethylene, polypropylene, polybutene, etc.; silicones having a softening point under heat; fatty acid amides such as oleamide, erucic amide, ricinoleic amide, stearamide, etc.; vegetable waxes such as carnauba wax, rice wax, candelilla wax, haze wax, jojoba oil, etc.; animal waxes such as bees wax, etc.; mineral and petroleum waxes such as montan wax, ozocerite, ceresine, paraffin wax, microcrystalline wax, Fisher-Tropsch wax, etc.; and their modified derivatives. These waxes may be dispersed in water along with an ionic surfactant or a polyelectrolyte such as a polymer acid or a polymer base, and homogenized in a homogenizer or a pressure jet dispersing machine in which the dispersed particles are heated at a temperature not lower than their melting point with strong shear force being applied thereto. Through the process, obtained is a dispersion of release agent particles not larger than 1 $\mu$m in size.

The particle size of the release agent particles in their dispersion may be measured with a laser-diffractiometric particle size analyzer (e.g., Horiba Seisakusho's LA-700).

Preferably, the release agent content of the toner falls between 5 and 25% by weight. The toner production will be described hereinunder. Considering the chargeability, the durability and the releasability of the toner, it is desirable that, in the process of toner production, the release agent is added to the cohesive matrix particles in the step of preparing the particles, and adding the release agent thereto in the subsequent step where additional particles are added thereto is undesirable.

The toner for developing an electrostatic image of the invention may contain a charge control agent which is for further stabilizing the chargeability of the toner. Any and every type of charge control agents is usable herein, including, for example, quaternary ammonium compounds, nigrosine compounds, dye complexes with aluminum, iron, chromium or the like, triphenylmethane pigments, etc. However, preferred are those hardly soluble in water, as their ability to control the ionic strength—which will have some influences on the process stability in producing the toner by cohering and melting the constituent particles—is good, and as they do not contaminate liquid wastes.

To the toner for developing an electrostatic image of the invention, optionally added are inorganic particles in wet for stabilizing the chargeability of the toner. The inorganic particles may be any external additives to ordinary toners, and include, for example, silica, alumina, titania, calcium carbonate, magnesium carbonate, tricalcium phosphate, etc. They may be processed with an ionic surfactant, a polymer acid, a polymer base or the like for dispersing them.

To the toner after dried, optionally added in dry are inorganic particles such as silica, alumina, titania or calcium carbonate, or resin particles of, for example, vinylic resin, polyester or silicone, for improving the flowability and the cleanability of the toner, like to ordinary toners. The particles may be applied to the surfaces of the toner particles under shear force in dry.

In the process of toner production of the invention, optionally added to the system is a surfactant for facilitating emulsion polymerization, pigment dispersion, resin particle dispersion, release agent dispersion, and cohesion or stabilization of the particles formed. Examples of the surfactant are mentioned below.

The surfactant includes anionic surfactants such as salts of sulfates, salts of sulfonic acids, phosphates, soaps, etc.; and cationic surfactants such as amine salts, quaternary ammonium salts, etc. The anionic surfactants and the cationic surfactants may be combined with nonionic surfactants such as polyethylene glycols, alkylphenol-ethylene oxide adducts, polyalcohols, etc., for enhancing their effect. For dispersing the toner particles, any ordinary dispersing machine may be used, including, for example, rotary shear homogenizers, and media-assisted mills such as ball mills, sand mills, Dyno mills, etc.

The method of the invention for producing the toner for developing an electrostatic image includes mixing at least a resin particle dispersion of resin particles of at most 1 $\mu$m in size, a colorant dispersion, a release agent dispersion and an inorganic particle dispersion to prepare a dispersion of agglomerate particles that contain at least the resin particles and the colorant, and then heating the resulting dispersion at a temperature not lower than the glass transition point or the melting point of the resin particles to thereby melt and integrate the agglomerate particles into toner particles.

The resin particle dispersion can be prepared in a process of emulsion polymerization. A colorant is dispersed in the presence of an ionic surfactant, of which the polarity is opposite to that of the ionic surfactant to be in the resin particle dispersion; then the resulting colorant dispersion is mixed with the resin particle dispersion to form, as a result of hetero-cohesion of the two, cohesive particles of which the particle size corresponds to that of the toner particles to be produced herein; and thereafter the cohesive particle dispersion is heated at a temperature not lower than the glass transition point or the melting point of the resin particles to thereby melt them to form toner particles.

For hetero-cohesion, the starting dispersions may be mixed and cohered all at a time. Apart from this, however, the amounts of the initial ionic polar dispersants may be unbalanced. For example, the dispersions may be ionically neutralized with an inorganic metal salt such as potassium nitrate, or a tetravalent aluminium salt such as polyaluminium chloride or polyaluminium hydroxide, or their polymer; then the first-stage cohesive matrix particles are formed at a temperature lower than the glass transition point of the resin particles, and stabilized; and thereafter a particle dispersant, of which the amount and the polarity are specifically selected so as to compensate for the ionic unbalance, is added to the matrix particles in the second stage, and optionally the particles are slightly heated at a temperature not higher than the glass transition point or the melting point of the resin contained in the matrix particles or in the additional particles to thereby stabilize them at a higher temperature; and finally the cohesive matrix particles are heated at a temperature not lower than the glass transition point or the melting point of the resin, and are thereby melted with the particles added in the second stage being still on their surfaces, and the toner particles are thus formed. The batch operation for cohesion may be repeated a few times.

After having been formed through the step of melting and forming the particles, the toner particles are washed and dried to be the toner of the invention. In view of the chargeability of the toner, it is desirable that the toner particles are fully washed for complete substitution with ion-exchange water. The washed system is subjected to solid-liquid separation, for which the method is not specifically defined. However, in view of the productivity, preferred is suction filtration or pressure filtration. The method of drying the washed toner particles is not also specifically defined. In view of the productivity, however, preferred is freeze-drying, flush-jet drying, fluidized drying, or fluidized drying under shake.

The volume-average particle size $D_{50}$ of the toner for developing an electrostatic image of the invention, thus produced in the manner as above, preferably falls between 2 and 9 μm, more preferably between 3 and 8 μm. If the size is less than 2 μm, the chargeability of the toner will be poor and the developability with the toner will lower; but if larger than 9 μm, the image resolution with the toner will lower.

Also preferably, the volume-average particle size distribution index GSDv of the toner of the invention is at most 1.30. If the index is larger than the value, the image resolution with the toner will lower. Also preferably, the ratio of the volume-average particle size distribution index to the number-average particle size distribution index GSDp, GSDv/GSDp, is at least 0.95. If the ratio is lower than the value, the chargeability of the toner will be low, and the toner will scatter or will be fogged.

The volume-average particle size $D_{50}$, the volume-average particle size distribution index GSDv and the number-average particle size distribution index GSDp of the toner may be derived from the particle size distribution of the toner measured, for example with an analyzer such as a Coulter counter (Nikkaki's TAII) or Nikkaki's Multisizer II. Concretely, the particle size distribution of the toner measured is divided into particle size ranges (channels); and a cumulative distribution curve is drawn from the range of smaller particles. On the curve, the particle size giving a particle accumulation of 16% is defined as a volume-average particle size $D_{16v}$ and a number-average particle size $D_{16p}$; that giving a particle accumulation of 50% is defined as a volume-average particle size $D_{50v}$ and a number-average particle size $D_{50p}$; and that giving a particle accumulation of 84% is defined as a volume-average particle size $D_{84v}$ and a number-average particle size $D_{84p}$. The volume-average particle size distribution index GSDv is represented by $(D_{84v}/D_{16v})^{0.5}$; and the number-average particle size distribution index GSDp is represented by $(D_{84p}/D_{16p})^{0.5}$.

The morphology parameter SF1 of the toner of the invention preferably falls between 100 and 140, in view of its image-forming ability. More preferably, the morphology parameter SF1 falls between 110 and 135. The morphology parameter SF1 of the toner is obtained as follows: A sample of the toner is spread on a slide glass, its optical microscopic image is inputted into a LUZEX image analyzer (manufactured by Nireco Corporation) via a video camera, the peripheral length (ML) and the projected area (A) of at least 50 toner particles seen on the image are measured, and the mean value indicating the morphology parameter SF1 of the toner is obtained from $(ML^2/A)$.

Preferably, the complex viscosity η* at 160° C. of the toner of the invention, measured through temperature dispersion analysis in a sinusoidal oscillation method, falls between $3.0\times10^2$ and $1.2\times10^3$ Pas; and the loss tangent tan δ thereof falls between 0.6 and 1.8. Falling within the defined range, the toner has good fixation characteristics. Concretely, it can fuse even in high-speed low-pressure fusers, and the fixed toner images are readily released, not depending on varying temperatures, or that is, the temperature dependency of the releasability of the fixed toner images is low. In addition, the releasability of the fixed toner images does not depend on the amount of the toner spread to form the images; the surface gloss of the fixed toner images is good; and the OHP transparency thereof is good. Further, the fixed toner images have good folding resistance.

If the complex viscosity η* of the toner is lower than $3.0\times10^2$ Pas, the cohesive force of the binder resin itself will be low, and the toner often cause offset at high temperatures. On the other hand, if it is higher than $1.2\times10^3$ Pas, the cohesive force of the binder resin itself will be too high, and the fixed toner images could not have a good gloss on their surface. More preferably, the complex viscosity η* of the toner falls between $3.5\times10^2$ and $1.0\times10^3$ Pas.

If the loss tangent tan δ of the toner is less than 0.6, the storage elastic modulus that indicates the elasticity factor thereof increases, and the surface gloss of the fixed toner images is therefore lowered. If tan δ is larger than 1.8, only the stickiness of the binder resin itself increases and the cobwebbing resistance of the fused toner will worsen, and, as a result, the toner releasability in oilless fixation will be poor. More preferably, the loss tangent tan δ of the toner falls between 0.8 and 1.7.

The dynamic viscoelasticity of the toner is derived from the complex viscosity η* and the loss tangent tan δ thereof measured through temperature dispersion analysis in a sinusoidal oscillation method at a frequency of 6.28 rad/sec. For this, for example, used is a Rheometric Scientific's meter unit, ARES. One method for measuring the dynamic viscoelasticity of the toner is described. A tablet of the toner is put on a parallel plate disc having a diameter of 25 mm, and the normal force is set at 0. Then, this is sinusoidally oscillated at a frequency of 6.28 rad/sec. Measuring it is started at 120° C. and is continued up to 200° C. The measurement is effected at intervals of 30 seconds. During the measurement, the temperature fluctuation is preferably at most ±1.0° C. for the accuracy of the measurement. During the measurement, the strain of the sample is well controlled at every temperature at which the sample is measured, so as to ensure faithful data.

In general, the stickiness of fused toner has an influence on the cobwebbing property thereof. Cobwebbing is intrinsic to polymers. Toner that cobwebs more is less releasable in oilless fixation. The cobwebbing property of toner is influenced by the weight-average molecular weight Mw of the binder resin in the toner, the presence or absence of crosslinking in the binder resin and the crosslink density therein. In particular, toner cobwebs when its elasticity and stickiness fall within specific ranges. Toner, if having a high elasticity and having a high crosslink density, can be readily prevented from cobwebbing at practical fixation temperatures. However, the fixed images of the toner could not have a good surface gloss. The problem is serious when the toner contains an amorphous binder resin. On the other hand, toner of low elasticity does not cobweb so much and its fixed images could have a good surface gloss. However, the toner of the type often causes offset at high temperatures and its use is therefore impractical. Accordingly, in order to obtain glossy and releasable toner images in oilless fixation, the toner to be used must not cobweb even though its elasticity is low and the crosslink density therein is low, or that is, the elasticity and the stickiness of the toner must be well balanced. Concretely, the balance of the elasticity and the stickiness of the toner must be so controlled that the complex viscosity η* of the toner to be derived from the dynamic viscoelasticity thereof falls within a predetermined range and that the loss tangent tan δ(=loss elastic modulus/storage elastic modulus) of the toner also falls within a predetermined range.

To control the complex viscosity η* and the loss tangent tan δ of the toner of the invention, an inorganic particles (A) having a mean primary particle size of from 5 to 30 nm and an inorganic particles (B) having a mean primary particle size of from 30 to 200 nm are added to and mixed with the toner in a ratio (A/B) falling between 0.7 and 3.0, and the total of the two A and B falls between 0.5 and 10% by weight of the toner.

Preferably, the quantity of charge of the toner for developing an electrostatic image of the invention falls between 20 and 40 $\mu$C/g. If the quantity of charge of the toner is lower than 20 $\mu$C/g, the non-image area will be stained (fogged); but if higher than 40 $\mu$C/g, the image density will be low. Also preferably, the ratio of the quantity of charge of the toner in summer (30° C., 85% RH) to that in winter (10° C., 35% RH) falls between 0.5 and 1.5. If the ratio oversteps the range, the quantity of charge of the toner will much fluctuate, depending on the ambient environment, and the toner loses charge stability, and is therefore unfavorable for practical use. More preferably, the quantity of charge of the toner falls between 20 and 35 $\mu$C/g; and the ratio of the quantity of charge of the toner in summer to that in winter falls between 0.7 and 1.3.

The image forming method of the invention includes a step of forming a latent image on a latent image bearing member, a step of developing the latent image with a developer on a developer bearing member to form a toner image, a step of transferring the toner image onto a transfer medium, and a step of fixing the toner image on the transfer medium. The toner of the invention can well exhibit its effect even when it is used in a conventional fuser in which a transfer medium is passed between two thermal fuser rollers for image fixation thereon. However, the toner of the invention is more favorable to a free belt nip fuser (FBNF) system including a thermal fuser roller and an endless belt, and gives better images of high surface smoothness, as compared with conventional toners.

The image forming apparatus of the invention includes an electrostatic latent image bearing member, a developer bearing member, a development unit in which an electrostatic latent image is developed with the developer held on the developer bearing member, a transfer unit in which the developed toner image is transferred onto a transfer medium, and a fuser unit in which the toner image on the transfer medium is fixed. In the apparatus, the fuser unit is preferably an FBNF system unit, as so mentioned above. One example of the FBNF system unit for use in the invention is described below. This includes a thermal fuser roller and an endless belt. The thermal fuser roller has a cylindrical core coated with a heat-resistant elastic layer, and the elastic layer is further coated with a heat-resistant resin layer. The endless belt is provided with a pressure member inside it, and it forms a nip part at which it is brought into contact with the thermal fuser roller at a predetermined angle. The pressure member presses the endless belt against the thermal fuser roller so that the heat-resistant elastic layer of the thermal fuser roller is distorted. Through the nip part between the thermal fuser roller and the endless belt, a recording sheet with toner images thereon is passed and the toner images are fixed on the sheet under heat and pressure.

One example of the apparatus for the image forming method of the invention is in FIG. 1, and this is equipped with a belt fuser. The apparatus includes a photoreceptor drum 1 with a charger 2, an image-writing unit 3 such as laser, a development unit 4, a primary transfer unit 5 and a cleaning unit 6 being disposed in that order around it in the direction of drum direction. Black, yellow, magenta and cyan toners are housed in the development members $\mathbf{4}_1$ to $\mathbf{4}_4$ of the development unit 4. An intermediate transfer belt 7 is brought into contact with the surface of the photoreceptor drum 1, running between the photoreceptor drum 1 and the primary transfer unit 5 in the direction of the arrow. The belt 7 is held under tension by tension rolls 8*a*, 8*b*, 8*c* and a backup roll 9. Opposite to the backup roll 9 and the tension roll 8*a*, disposed are a bias roll 10 and a belt cleaner 11, respectively. The backup roll 9 is kept in contact with a voltage roll 12.

The area in which the primary transfer unit 5 is pressed against the photoreceptor drum 1 via the intermediate transfer belt 7 therebetween is a primary transfer zone; and the area in which the bias roll 10 is pressed against the backup roll 9 is a secondary transfer zone. On the transfer paper P fed from a paper tray 13 to the secondary transfer zone, transferred are the toner images from the intermediate transfer belt 7, and the paper P with the toner images thereon is conveyed into a fuser 14 that includes a pressure roll 15 with an internal heater therein and a transfer belt 16, and the toner images are thus fixed on the paper P in the fuser 14. Inside the transfer belt 16, disposed are a pressure pad 17, which is to press the transfer belt 16 against the pressure roll 15, and a belt guide 18.

Figure 2:
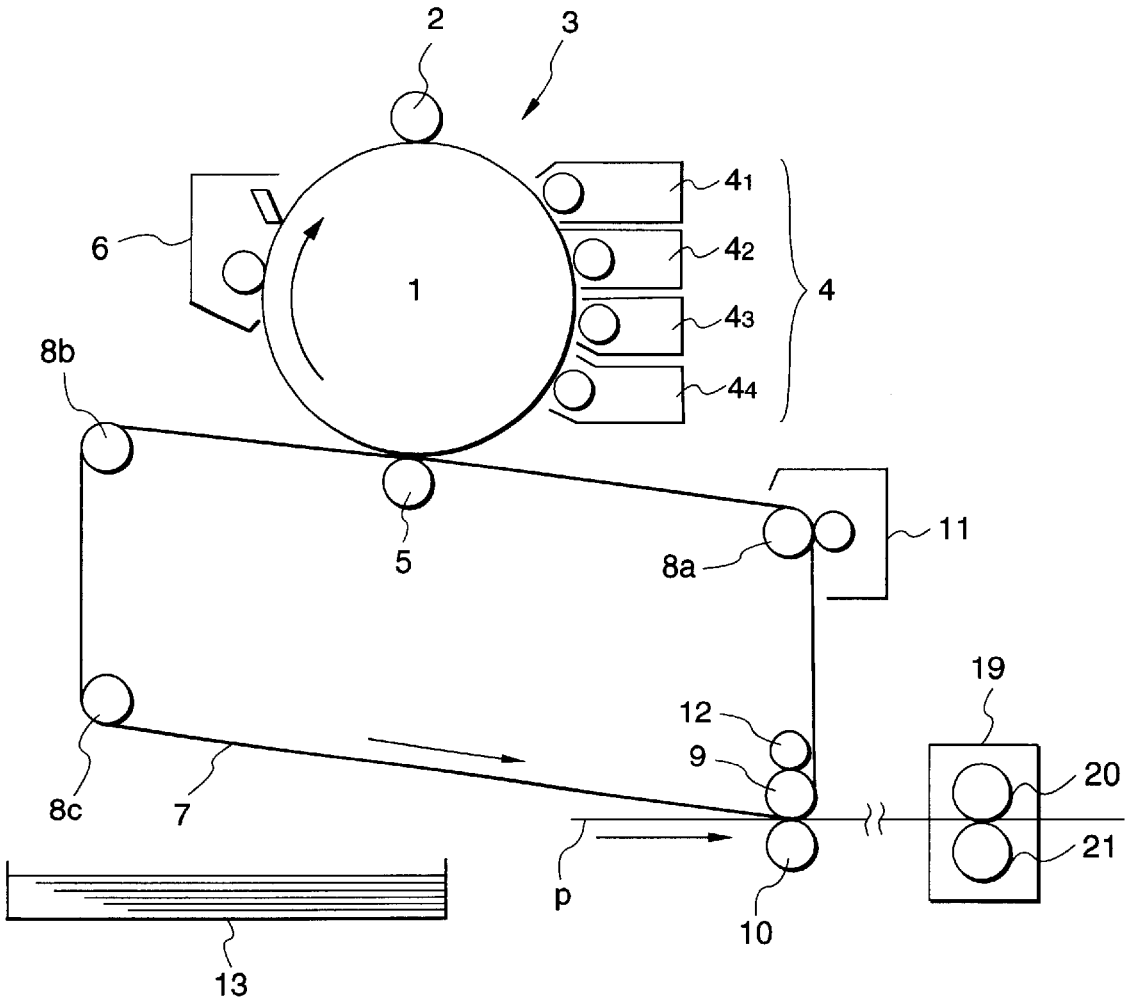
FIG. 2 is a schematic view showing another example of the apparatus for carrying out the image forming method of the invention, which is equipped with a two-roll fuser.

FIG. 2 shows an another example of the apparatus for the image forming method of the invention. This includes a two-roll fuser, being different from the apparatus of FIG. 1 that includes a belt fuser. The other constitution of the apparatus of FIG. 2 is the same as that of the apparatus of FIG. 1. The two-roll fuser 19 in the apparatus of FIG. 2 includes a pressure roll 20 and a fuser roll 21, and the constitution of these rolls may be the same as that of the pressure roll in FIG. 1.

EXAMPLES

The invention is described in more detail with reference to the following Examples, which, however, are not whatsoever intended to restrict the scope of the invention.

Preparation of Resin Particle Dispersion

| | |
|---|---|
| Styrene (from Wako Pure Chemicals) | 325 wt. pts. |
| N-butyl acrylate (from Wako Pure Chemicals) | 75 wt. pts. |
| β-carboxyethyl acrylate (from Rhodia Nikka) | 9 wt. pts. |
| 1,10-Decanediol diacrylate (from Shin-Nakamura Chemical) | 1.5 wt. pts. |
| Dodecanethiol (from Wako Pure Chemicals) | 2.7 wt. pts. |

These ingredients are premixed and dissolved to prepare a solution. A surfactant solution of 4 g of an anionic surfactant (Dow-Chemical's Dowfax A211) dissolved in 550 g of ion-exchanged water is put into a flask, and 413.2 g of the above solution is added thereto, and dispersed and emulsified. With gently stirring and mixing it for 10 minutes, 6 g of ammonium persulfate dissolved in 50 g of ion-exchanged water is added thereto. Next, the system in the flask is fully purged with nitrogen, and this is heated up to 70° C. in an oil bath with still stirring. In that condition, the emulsion polymerization is continued for 5 hours to give a dispersion of resin particles. The resin particles are separated from the dispersion, and analyzed for their physical properties. The mean primary particle size of the resin particles is 195 nm; the solid content of the dispersion is 42%; the glass transition point of the resin particles is 51.5° C.; and the weight-average molecular weight Mw of the resin particles is 32000.

Preparation of Colorant Dispersion (1)

| | |
|---|---|
| Cyan Pigment (Dainichi Seika's Copper Phthalocyanine B15:3) | 45 wt. pts. |

-continued

| | |
|---|---|
| Nonionic Surfactant (Sanyo Chemical's Nonipol 400) | 5 wt. pts. |
| Ion-exchanged Water | 200 wt. pts. |

These ingredients are mixed and dissolved, and dispersed for 10 minutes in a homogenizer (IKA's Ultratalax) to give a colorant dispersion (1) in which the mean primary particle size of the colorant particles is 168 nm.

Preparation of Colorant Dispersion (2)

| | |
|---|---|
| Yellow Pigment (Clariant's PY74) | 45 wt. pts. |
| Nonionic Surfactant (Sanyo Chemical's Nonipol 400) | 5 wt. pts. |
| Ion-exchanged Water | 200 wt. pts. |

These ingredients are mixed and dissolved, and dispersed for 10 minutes in a homogenizer (IKA's Ultratalax) to give a colorant dispersion (2) in which the mean primary particle size of the colorant particles is 148 nm.

Preparation of Colorant Dispersion (3)

| | |
|---|---|
| Magenta Pigment (Dainichi Seika's R122) | 45 wt. pts. |
| Nonionic Surfactant (Sanyo Chemical's Nonipol 400) | 5 wt. pts. |
| Ion-exchanged Water | 200 wt. pts. |

These ingredients are mixed and dissolved, and dispersed for 10 minutes in a homogenizer (IKA's Ultratalax) to give a colorant dispersion (3) in which the mean primary particle size of the colorant particles is 176 nm.

Dispersion of Inorganic Particles $A_1$

For inorganic particles $A_1$, directly used is colloidal silica (Nissan Chemical's, ST-OS, having a mean primary particle size of 8 nm and a solid powder content of 20%).

Dispersion of Inorganic Particles $A_2$

For inorganic particles $A_2$, directly used is colloidal silica (Nissan Chemical's, ST-O, having a mean primary particle size of 20 nm and a solid powder content of 20%).

Dispersion of Inorganic Particles $B_1$

For inorganic particles $B_1$, directly used is colloidal silica (Nissan Chemical's, ST-OL, having a mean primary particle size of 40 nm and a solid powder content of 20%).

Dispersion of Inorganic Particles $B_2$

For inorganic particles $B_2$, directly used is colloidal silica (Nissan Chemical's, ST-100, having a mean primary particle size of 100 nm and a solid powder content of 20%).

Preparation of Release Agent Dispersion

| | |
|---|---|
| Polyethylene Wax (Toyo Petrolite's PW725, having a melting point of 103° C.) | 45 wt. pts. |
| Cationic Surfactant (Dai-ichi Pharmaceutical's Neogen RK) | 5 wt. pts. |
| Ion-exchanged Water | 200 wt. pts. |

These ingredients are heated at 95° C., and well dispersed in a homogenizer (IKA's Ultratalax T50), and then further dispersed in a pressure-jet Gaulin homogenizer to give a release agent dispersion. In the dispersion, the release agent particles have a mean primary particle size of 186 nm, and the solid content of the dispersion is 21.5%.

Production of Toner Particles (1)

| | |
|---|---|
| Resin Particle Dispersion | 80 wt. pts. |
| Colorant Dispersion (1) | 40 wt. pts. |
| Dispersion of Inorganic Particles $A_1$ (mean primary particle size = 8 nm) | 6.5 wt. pts. |
| Dispersion of Inorganic Particles $B_1$ (mean primary particle size = 40 nm) | 6.5 wt. pts. |
| Release Agent Dispersion | 40 wt. pts. |
| Polyaluminium Chloride | 0.41 wt. pts. |

173.43 g of a mixture of these ingredients is put into a round-bottomed stainless flask, and well mixed and dispersed in a homogenizer (IKA's Ultratalax T50). While stirred, this is heated up to 47° C. in a oil bath heater and then kept at 47° C. for 60 minutes to prepare a dispersion of cohesive particles. To the cohesive particle dispersion, gently added is 31 g of the above resin particle dispersion.

Next, an aqueous solution of sodium hydroxide (0.5 mols/liter) is added thereto to make the dispersion have a pH of 5.4. The flask with the dispersion therein being hermetically sealed, heated up to 96° C. and kept at the temperature for 5 hours with its contents being kept stirred with a magnetic seal.

After thus reacted, this is cooled, filtered, and well washed with ion-exchanged water. Then, this is subjected to solid-liquid separation through a Nutsche suction filter. This is re-dispersed in 3 liters of ion-exchanged water at 40° C., and washed with stirring for 15 minutes at 300 rpm. This operation is repeated further 5 times. When its filtrate has come to have a pH of 7.01, an electric conductivity of 9.8 $\mu$S/cm and a surface tension of 71.1 Nm, this is further subjected to solid-liquid separation through a Nutsche suction filter No. 5A, and then dried in vacuum for 12 hours to obtain toner particles (1).

The particle size of the toner particles (1) is measured with a Coulter counter. Their volume-average particle size $D_{50}$ is 5.4 $\mu$m, and their volume-average particle size distribution index GSDv is 1.21. The toner particles (1) are analyzed with the LUZEX image analyzer, and their morphology parameter SF1 is 118.3. This means that the toner particles (1) are spherical.

The complex viscosity $\eta^*$ at 160° C. of the toner particles (1), obtained through dynamic viscoelastometry, is $4.4\times10^2$ Pas, and the loss tangent tan $\delta$ thereof is 1.32.

The content ratio of the inorganic particles A to B, A/B, in the toner is 1; and the total content, A+B, therein is 4.7% by weight of the toner.

Production of Toner Particles (2)

Toner particles (2) are produced in the same manner as in producing the toner particles (1), except that the amount of the dispersion of inorganic particles $A_1$ (mean primary particle size=8 nm) and that of the dispersion of inorganic particles $B_1$ (mean primary particle size=40 nm) are varied to 15.4 parts by weight and 10.4 parts by weight, respectively.

The particle size of the toner particles (2) is measured with a Coulter counter. Their volume-average particle size $D_{50}$ is 5.4 $\mu$m, and their volume-average particle size distribution index GSDv is 1.21. The toner particles (2) are analyzed with the LUZEX image analyzer, and their morphology parameter SF1 is 118.3. This means that the toner particles (2) are spherical.

The complex viscosity $\eta^*$ at 160° C. of the toner particles (2), obtained through dynamic viscoelastometry, is $9.7\times10^2$ Pas, and the loss tangent tan $\delta$ thereof is 1.02.

The content ratio of the inorganic particles A to B, A/B, in the toner is 1.48; and the total content, A+B, therein is 9.0% by weight of the toner.

Production of Toner Particles (3)

Toner particles (3) are produced in the same manner as in producing the toner particles (1), except that the amount of the dispersion of inorganic particles $A_1$ (mean primary particle size=8 nm) and that of the dispersion of inorganic particles $B_1$ (mean primary particle size=40 nm) are varied to 6.8 parts by weight and 3.4 parts by weight, respectively.

The particle size of the toner particles (3) is measured with a Coulter counter. Their volume-average particle size $D_{50}$ is 5.4 μm, and their volume-average particle size distribution index GSDv is 1.20. The toner particles (3) are analyzed with the LUZEX image analyzer, and their morphology parameter SF1 is 116.3. This means that the toner particles (3) are spherical.

The complex viscosity η* at 160° C. of the toner particles (3), obtained through dynamic viscoelastometry, is $5.3\times10^2$ Pas, and the loss tangent tans thereof is 1.21.

The content ratio of the inorganic particles A to B, A/B, in the toner is 2.0; and the total content, A+B, therein is 3.8% by weight of the toner.

Production of Toner Particles (4)

Toner particles (4) are produced in the same manner as in producing the toner particles (1), except that the amount of the dispersion of inorganic particles $A_1$ (mean primary particle size=8 nm) and that of the dispersion of inorganic particles $B_1$ (mean primary particle size=40 nm) are varied to 9.1 parts by weight and 3.9 parts by weight, respectively.

The particle size of the toner particles (4) is measured with a Coulter counter. Their volume-average particle size $D_{50}$ is 5.4 μm, and their volume-average particle size distribution index GSDv is 1.23. The toner particles (4) are analyzed with the LUZEX image analyzer, and their morphology parameter SF1 is 115.6. This means that the toner particles (4) are spherical.

The complex viscosity η* at 160° C. of the toner particles (4), obtained through dynamic viscoelastometry, is $4.8\times10^2$ Pas, and the loss tangent tan δ thereof is 1.22.

The content ratio of the inorganic particles A to B, A/B, in the toner is 2.82; and the total content, A+B, therein is 4.75% by weight of the toner.

Production of Toner Particles (5)

Toner particles (5) are produced in the same manner as in producing the toner particles (1), except that the amount of the dispersion of inorganic particles $A_1$ (mean primary particle size=8 nm) and that of the dispersion of inorganic particles $B_1$ (mean primary particle size=40 nm) are varied to 0.68 parts by weight and 0.68 parts by weight, respectively.

The particle size of the toner particles (5) is measured with a Coulter counter. Their volume-average particle size $D_{50}$ is 5.4 μm, and their volume-average particle size distribution index GSDv is 1.21. The toner particles (5) are analyzed with the LUZEX image analyzer, and their morphology parameter SF1 is 115.3. This means that the toner particles (5) are spherical.

The complex viscosity η* at 160° C. of the toner particles (5), obtained through dynamic viscoelastometry, is $3.8\times10^2$ Pas, and the loss tangent tan δ thereof is 1.70.

The content ratio of the inorganic particles A to B, A/B, in the toner is 1; and the total content, A+B, therein is 0.51% by weight of the toner.

Production of Toner Particles (6)

Toner particles (6) are produced in the same manner as in producing the toner particles (1), except that the amount of the dispersion of inorganic particles $A_1$ (mean primary particle size=8 nm) and that of the dispersion of inorganic particles $B_1$ (mean primary particle size=40 nm) are varied to 9.7 parts by weight and 13.3 parts by weight, respectively.

The particle size of the toner particles (6) is measured with a Coulter counter. Their volume-average particle size $D_{50}$ is 5.4 μm, and their volume-average particle size distribution index GSDv is 1.21. The toner particles (6) are analyzed with the LUZEX image analyzer, and their morphology parameter SF1 is 119.1. This means that the toner particles (6) are spherical.

The complex viscosity η* at 160° C. of the toner particles (6), obtained through dynamic viscoelastometry, is $1.1\times10^3$ Pas, and the loss tangent tan δ thereof is 0.83.

The content ratio of the inorganic particles A to B, A/B, in the toner is 0.72; and the total content, A+B, therein is 8.1% by weight of the toner.

Production of Toner Particles (7)

Toner particles (7) are produced in the same manner as in producing the toner particles (1), except that 5.2 parts by weight of a dispersion of inorganic particles $A_2$ (mean primary particle size=20 nm) is added in place of the dispersion of inorganic particles $A_1$ and that the amount of the dispersion of inorganic particles $B_1$ (mean primary particle size=40 nm) is varied to 3.3 parts by weight.

The particle size of the toner particles (7) is measured with a Coulter counter. Their volume-average particle size $D_{50}$ is 5.4 μm, and their volume-average particle size distribution index GSDv is 1.19. The toner particles (7) are analyzed with the LUZEX image analyzer, and their morphology parameter SF1 is 114.2. This means that the toner particles (7) are spherical.

The complex viscosity η* at 160° C. of the toner particles (7), obtained through dynamic viscoelastometry, is $4.2\times10^2$ Pas, and the loss tangent tan δ thereof is 1.30.

The content ratio of the inorganic particles A to B, A/B, in the toner is 1.57; and the total content, A+B, therein is 3.16% by weight of the toner.

Production of Toner Particles (8)

Toner particles (8) are produced in the same manner as in producing the toner particles (1), except that the amount of the dispersion of inorganic particles $A_1$ (mean primary particle size=8 nm) is varied to 7.8 parts by weight and that 6.5 parts by weight of a dispersion of inorganic particles $B_2$ (mean primary particle size=100 nm) is added in place of the dispersion of inorganic particles $B_1$.

The particle size of the toner particles (8) is measured with a Coulter counter. Their volume-average particle size $D_{50}$ is 5.4 μm, and their volume-average particle size distribution index GSDv is 1.20. The toner particles (8) are analyzed with the LUZEX image analyzer, and their morphology parameter SF1 is 115.7. This means that the toner particles (8) are spherical.

The complex viscosity η* at 160° C. of the toner particles (8), obtained through dynamic viscoelastometry, is $4.4\times10^2$ Pas, and the loss tangent tan δ thereof is 1.28.

The content ratio of the inorganic particles A to B, A/B, in the toner is 1.20; and the total content, A+B, therein is 5.21% by weight of the toner.

Production of Toner Particles (9)

Toner particles (9) are produced in the same manner as in producing the toner particles (1), except that 5.2 parts by weight of a dispersion of inorganic particles $A_2$ (mean primary particle size=20 nm) is added in place of the dispersion of inorganic particles $A_1$ and that 6.8 parts by weight of a dispersion of inorganic particles $B_2$ (mean primary particle size=100 nm) is added in place of the dispersion of inorganic particles $B_1$.

The particle size of the toner particles (9) is measured with a Coulter counter. Their volume-average particle size $D_{50}$ is 5.4 μm, and their volume-average particle size distribution index GSDv is 1.22. The toner particles (9) are analyzed with the LUZEX image analyzer, and their morphology parameter SF1 is 122.3. This means that the toner particles (9) are spherical.

The complex viscosity $\eta^*$ at 160° C. of the toner particles (9), obtained through dynamic viscoelastometry, is $1.04\times10^3$ Pas, and the loss tangent tan $\delta$ thereof is 0.86.

The content ratio of the inorganic particles A to B, A/B, in the toner is 0.67; and the total content, A+B, therein is 4.75% by weight of the toner.

Production of Toner Particles (10)

Toner particles (10) are produced in the same manner as in producing the toner particles (1), except that 6.8 parts by weight of a dispersion of inorganic particles $A_2$ (mean primary particle size=20 nm) is added in place of the dispersion of inorganic particles $A_1$ and that 3.4 parts by weight of a dispersion of inorganic particles $B_2$ (mean primary particle size=100 nm) is added in place of the dispersion of inorganic particles $B_1$.

The particle size of the toner particles (10) is measured with a Coulter counter. Their volume-average particle size $D_{50}$ is 5.4 $\mu$m, and their volume-average particle size distribution index GSDv is 1.21. The toner particles (10) are analyzed with the LUZEX image analyzer, and their morphology parameter SF1 is 122.1. This means that the toner particles (10) are spherical.

The complex viscosity $\eta^*$ at 160° C. of the toner particles (10), obtained through dynamic viscoelastometry, is $5.82\times10^2$ Pas, and the loss tangent tan $\delta$ thereof is 1.02.

The content ratio of the inorganic particles A to B, A/B, in the toner is 2.0; and the total content, A+B, therein is 3.77% by weight of the toner.

Production of Toner Particles (11)

Toner particles (11) are produced in the same manner as in producing the toner particles (1), except that the amount of the dispersion of inorganic particles $B_1$ (mean primary particle size=40 nm) is varied to 10.0 parts by weight and that no inorganic particles A are added.

The particle size of the toner particles (11) is measured with a Coulter counter. Their volume-average particle size $D_{50}$ is 5.3 $\mu$m, and their volume-average particle size distribution index GSDv is 1.22. The toner particles (11) are analyzed with the LUZEX image analyzer, and their morphology parameter SF1 is 117.1. This means that the toner particles (11) are spherical.

The complex viscosity $\eta^*$ at 160° C. of the toner particles (11), obtained through dynamic viscoelastometry, is $4.72\times10^3$ Pas, and the loss tangent tan $\delta$ thereof is 0.59.

The content of the inorganic particles B in the toner is 3.7% by weight of the toner.

Production of Toner Particles (12)

Toner particles (12) are produced in the same manner as in producing the toner particles (1), except that the amount of the dispersion of inorganic particles $A_1$ (mean primary particle size=8 nm) is varied to 10.0 parts by weight and that no inorganic particles B are added.

The particle size of the toner particles (12) is measured with a Coulter counter. Their volume-average particle size $D_{50}$ is 5.1 $\mu$m, and their volume-average particle size distribution index GSDv is 1.22. The toner particles (12) are analyzed with the LUZEX image analyzer, and their morphology parameter SF1 is 118.3. This means that the toner particles (12) are spherical.

The complex viscosity $\eta^*$ at 160° C. of the toner particles (12), obtained through dynamic viscoelastometry, is $4.32\times10^2$ Pas, and the loss tangent tan $\delta$ thereof is 1.83.

The content of the inorganic particles A in the toner is 3.7% by weight of the toner.

Production of Toner Particles (13)

Spherical toner particles (13) are produced in the same manner as in producing the toner particles (1), except that a colorant dispersion (2) is added in place of the colorant dispersion (1). Their volume-average particle size $D_{50}$ is 5.3 $\mu$m; their GSDv is 1.23; and their morphology parameter SF1 is 116.9. Their complex viscosity $\eta^*$ at 160° C., obtained through dynamic viscoelastometry, is $4.21\times10^2$ Pas, and their loss tangent tan $\delta$ is 1.21.

Production of Toner Particles (14)

Spherical toner particles (14) are produced in the same manner as in producing the toner particles (1), except that a colorant dispersion (3) is added in place of the colorant dispersion (1). Their volume-average particle size $D_{50}$ is 5.5 $\mu$m; their GSDv is 1.21; and their morphology parameter SF1 is 118.2. Their complex viscosity $\eta^*$ at 160° C., obtained through dynamic viscoelastometry, is $4.06\times10^2$ Pas, and their loss tangent tan $\delta$ is 1.29.

Formulation of Developers

To 50 g of any one type of the toner particles (1) to (14), added is 1.5 g of hydrophobic silica (Cabot's TS720), and blended in a sample mill to obtain toners (1) to (14) for two-component developers. On the other hand, ferrite carrier cores having a mean particle size of 50 $\mu$m are coated with a methacrylate (from Soken Chemical) to prepare 1% methacrylate-coated carrier particles. The toner and the carrier are separately metered, and mixed in a ball mill for 5 minutes to form developers (1) to (14) each having a toner concentration of 5%.

Examples 1 to 12, Comparative Examples 1 and 2

Any of the developers (1) to (14) is applied to a laboratory duplicator modified from a Fuji Xerox's color duplicator, A Color 635 Model, and tested for their developability. In the laboratory duplicator, the nip width in the fuser unit is 6.5 mm; the fixation speed is 200 mm/sec; the fixation temperature is 180° C.; the pressure is 2.5 kg/cm$^2$; and the toner dose is 10.5 g/m$^2$. This is high-speed, low-pressure, low-power condition, under which the developer is tested for image fixation.

The matters tested are (1) the presence or absence of resistance in releasing the transfer paper with images fixed thereon from the fuser roller, or that is, the releasability of the transfer paper; (2) the presence or absence of offset on the transfer paper; (3) the presence or absence of image defects when the transfer paper with images fixed thereon is folded in two and is again unfolded, or that is, the folding resistance of the fixed images; and (4) the surface glossiness of the fixed images, and the presence or absence of turbidity in the transparent images on OHP sheets, or that is, the transparency of the fixed images. The test results are given in Table 1.

Example 13

The developers (1), (13) and (14) are applied to a laboratory duplicator modified from a Fuji Xerox's color duplicator, DC 1250 Model, in which primary color, secondary color and tertiary color images are formed, and these are combined. The gloss of each color image is measured, and the gloss difference between the different color images is obtained. The laboratory duplicator used herein is modified from a Fuji Xerox's color duplicator, DC1250 Model. Briefly, the rubber roll in the fuser unit in the duplicator is coated with a perfluoroalkoxy resin so as to make the nip pressure in the fuser unit variable. In the thus-modified laboratory duplicator, the nip pressure is 2.5 kg/cm$^2$, and Fuji Xerox's copy paper, J paper (weight: 82 g/m$^2$) is tested for image fixation thereon with the developers (1), (13) and (14).

Example 14

The developer (1) is applied to a laboratory duplicator modified from a Fuji Xerox's color duplicator, A Color 635 Model, and tested for their developability. In the modified laboratory duplicator, the fuser unit includes a two-roll fuser (see the fuser unit in FIG. 2). The fixation condition in this Example is the same as that in Example 1, except that the fixation speed is 160 mm/sec herein.

The surface glossiness of the fixed images is measured with a Murakami Color Materials' gloss meter. Briefly, a ray of light incident on the image surface at an incident angle of 45 degrees is reflected thereon at a reflectance angle of 135 degrees, and the reflected light density is measured at varying temperatures relative to the predetermined incident light density. The image surface glossiness is represented by the ratio of the reflected light density to the incident light density. Images having a surface glossiness of at least 40% are glossy and good images.

The developer (11) tested in Comparative Example 1 is well releasable from the fuser roller and causes no offset. However, in the folding test, some deletions are found in the fixed images. In addition, the surface glossiness of the fixed images is low, and the OHP sheets are turbid.

TABLE 1

| | Example 1 | Example 2 | Example 3 | Example 4 | Example 5 | Example 6 | Example 7 | Example 8 | Example 9 |
|---|---|---|---|---|---|---|---|---|---|
| Toner Particles | (1) | (2) | (3) | (4) | (5) | (6) | (7) | (8) | (9) |
| Mean Primary Particle Size (nm) of Inorganic Particles A | 8 | 8 | 8 | 8 | 8 | 8 | 20 | 8 | 20 |
| Mean Primary Particle Size (nm) of Inorganic Particles B | 40 | 40 | 40 | 40 | 40 | 40 | 40 | 100 | 100 |
| Type of Fuser | belt fuser | belt fuser | belt fuser | belt fuser | belt fuser | belt fuser | belt fuser | belt fuser | belt fuser |
| Fixation Speed (mm/sec) | 200 | 200 | 200 | 200 | 200 | 200 | 200 | 200 | 200 |
| A/B | 1.00 | 1.48 | 2.0 | 2.82 | 1.00 | 0.72 | 1.57 | 1.20 | 0.76 |
| A + B (wt. %) | 4.70 | 9.00 | 3.80 | 4.75 | 0.51 | 8.1 | 3.16 | 5.21 | 4.40 |
| Releasability | good | good | good | good | good | good | good | good | good |
| Offset Resistance | good | good | good | good | good | good | good | good | good |
| Folding Resistance | good | good | good | good | good | good | good | good | good |
| Surface Glossiness | good | good | good | good | good | good | good | good | good |
| OHP Transparency | good | good | good | good | good | good | good | good | good |

| | Example 10 | Example 11 | Example 12 | Example 13 | Example 14 | Comp. Ex. 1 | Comp. Ex. 2 |
|---|---|---|---|---|---|---|---|
| Toner Particles | (10) | (13) | (14) | (1)(13)(14) | (1) | (11) | (12) |
| Mean Primary Particle Size (nm) of Inorganic Particles A | 20 | 8 | 8 | 8 | 8 | — | 8 |
| Mean Primary Particle Size (nm) of Inorganic Particles B | 100 | 40 | 40 | 40 | 40 | 40 | — |
| Type of Fuser | belt fuser | belt fuser | belt fuser | two-roll fuser | two-roll fuser | belt fuser | belt fuser |
| Fixation Speed (mm/sec) | 200 | 200 | 200 | 200 | 200 | 200 | 200 |
| A/B | 2.00 | 1.00 | 1.00 | 1.00 | 1.00 | — | — |
| A + B (wt. %) | 3.77 | 4.70 | 4.70 | 4.70 | 4.70 | 3.70 | 3.70 |
| Releasability | good | good | good | good | good | good | bad |
| Offset Resistance | good | good | good | good | good | good | some offset found |
| Folding Resistance | good | good | good | good | good | some deletions found | good |
| Surface Glossiness | good | good | good | good | good | poor | good |
| OHP Transparency | good | good | good | good | good | turbid | good |

Evaluation

The developers (1) to (10), (13) and (14) tested in Examples 1 to 12 and 14 have good releasability with no resistance in releasing the fixed images from the fuser roller, and they cause no offset at all. In the folding test, no image deletion is found, and the folding resistance of the fixed image is excellent. In addition, the surface glossiness of the fixed images is good, and the OHP sheet transparency thereof is also good as the images are not turbid.

In Example 13, the gloss of the primary color is 45% and is high; the gloss of the secondary color is 55%; and the gloss of the tertiary color is 58%. The gloss difference between the primary color and the secondary color is 10% and is low; and the gloss difference between the primary color and the tertiary color is 13% and is also low. Since the gloss difference between the different colors is small, the documents with the color images thereon are easy to see.

The developer (12) tested in Comparative Example 2 is poorly releasable from the fuser roller, and the surface gloss of the fixed images is not uniform because of the release failure. In addition, the developer (12) causes some offset. In the folding test, no image deletion is found, and the fixed images are glossy and their OHP sheet transparency is good as the images are not turbid.

Having the constitution described hereinabove, the invention has made it possible to provide a toner for developing an electrostatic image, which has excellent fixation characteristics of easy releasability of transfer sheets with fixed images thereon, good surface gloss of fixed images, good transparency of OHP sheets, and good folding resistance of fixed images, and, in addition, the invention has made it possible to form high-quality fixed images. In particular, the toner of the invention is free from the problems in the prior art mentioned hereinabove, even when used in an image-forming apparatus equipped with a high-speed, low-pressure, low-power fuser unit such as a belt fuser unit, and it forms high-quality fixed images. The advantage of the toner of the invention is that it always forms high-quality fixed images in any condition.

While the invention has been described in detail and with reference to specific embodiments thereof, it will be apparent to one skilled in the art that various changes and modifications can be made therein without departing from the spirit and scope thereof.

What is claimed is:

1. A toner for developing an electrostatic image, comprising a dispersion of:

a binder resin;

a colorant;

a release agent; and inorganic particles containing inorganic particles (A) having a mean primary particle size not less than approximately 5 nm and less than approximately 30 nm and inorganic particles (B) having a mean primary particle size not less than approximately 30 nm and less than approximately 200 nm.

2. The toner for developing an electrostatic image as claimed in claim 1, wherein the inorganic particles (A) have a mean primary particle size not less than approximately 5 nm and less than approximately 25 nm, and the inorganic particles (B) have a mean primary particle size not less than approximately 30 nm and less than approximately 150 nm.

3. The toner for developing an electrostatic image as claimed in claim 1, wherein the content ratio of the inorganic particles (A/B) is not less than approximately 0.7 and less than approximately 3.0 and the total content of the inorganic particles (A+B) is not less than approximately 0.5% by weight and less than approximately 10% by weight of the toner.

4. The toner for developing an electrostatic image as claimed in claim 1, wherein the toner has a complex viscosity not less than approximately $3.0\times10^2$ poises and less than approximately $1.2\times10^3$ poises at 160° C., measured by temperature dispersion analysis in a sinusoidal oscillation method, and has a loss tangent not less than approximately 0.6 and less than approximately 1.8.

5. The toner for developing an electrostatic image as claimed in claim 4, wherein the toner has a complex viscosity approximately between $3.5\times10^2$ and $1.0\times10^3$ poises at 160° C.

6. The toner for developing an electrostatic image as claimed in claim 1, wherein a gloss of a fixed image formed by the toner of one color has approximately at least 30%, a difference between the gloss of the fixed image formed by the toner of one color and a gloss of a fixed image formed by the toner of two colors is approximately at most 15%, and a difference between the gloss of the fixed image formed by the toner of one color and a gloss of a fixed image formed by the toner of three colors is approximately at most 25%.

7. A method for forming an image, comprising the steps of:

forming an electrostatic latent image on an electrostatic latent image bearing member;

developing the electrostatic latent image with a developer on a developer bearing member to form a toner image;

transferring the toner image onto a transfer medium; and fixing the toner image on the transfer medium, wherein the developer contains the toner as claimed in claim 1.

8. The method for forming an image as claimed in claim 7, wherein the transfer medium is a transfer sheet and a fixing speed is approximately twenty or more A4 sheets/min.

9. The method for forming an image as claimed in claim 7, wherein the fixing step uses a fixing device having a heat roll and an endless belt.

10. The method for forming an image as claimed in claim 9, wherein the heat roll comprises a cylindrical core coated with a heat-resistant elastic layer and with a heat-resistant resin layer, the endless belt has a pressure member inside thereof to form a nip having at least a part where the endless belt contacts with the pressure member and the heat roll.

11. A method for producing a toner for developing an electrostatic image, comprising the steps of:

mixing a dispersion of resin particles having not more than approximately 1 $\mu$m in size, a dispersion of a release agent and a dispersion of inorganic particles;

preparing a dispersion of aggregated particles; and heating a resulting dispersion to a temperature not lower than a glass transition point or a melting point of the resin particles to form toner particles, wherein the inorganic particles contain inorganic particles (A) having a mean primary particle size not less than approximately 5 nm and less than approximately 30 nm and inorganic particles (B) having a mean primary particle size not less than approximately 30 nm and less than approximately 200 nm.

12. The method for producing a toner for developing an electrostatic image as claimed in claim 11, comprising the steps of:

preparing a dispersion of resin particles not more than approximately 1 $\mu$m in size, a dispersion of the release agent, a dispersion of the inorganic particles and a dispersion of colorant particles; and mixing to prepare a dispersion of aggregated particles that contains the resin particles and the colorant particles.

13. The method for producing a toner for developing an electrostatic image as claimed in claim 11, comprising the step of:

preparing the dispersion of the aggregated particles by using a metal salt polymer as a coagulant.

14. The method for producing a toner for developing an electrostatic image as claimed in claim 13, wherein the metal salt polymer is a tetravalent aluminum salt polymer.

15. The method for producing a toner for developing an electrostatic image as claimed in claim 11, comprising the steps of:

mixing to prepare a dispersion of the aggregated particles;

adding a dispersion of the resin particles to the dispersion of the aggregated particles, the resin particles adhering on surfaces of the aggregated particles, to prepare a dispersion of cohesive particles; and heating a dispersion of the cohesive particles to form toner particles by melting the cohesive.

* * * * *